US010446912B2

(12) United States Patent
Choi et al.

(10) Patent No.: US 10,446,912 B2
(45) Date of Patent: Oct. 15, 2019

(54) ELECTRONIC DEVICE AND METHOD OF IMPROVING ANTENNA PERFORMANCE THEREOF

(71) Applicant: Samsung Electronics Co., Ltd, Gyeonggi-do (KR)

(72) Inventors: Hoon Choi, Gyeonggi-do (KR); Myungjin Kang, Gyeonggi-do (KR); Kyoungho Kim, Gyeonggi-do (KR); Kihun Lee, Gyeonggi-do (KR); Hanjun Yi, Gyeonggi-do (KR); Jongwook Choi, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 278 days.

(21) Appl. No.: 15/236,367

(22) Filed: Aug. 12, 2016

(65) Prior Publication Data

US 2017/0047640 A1 Feb. 16, 2017

(30) Foreign Application Priority Data

Aug. 12, 2015 (KR) ..... 10-2015-0113941

(51) Int. Cl.
*H01Q 1/24* (2006.01)
*H01Q 1/48* (2006.01)

(52) U.S. Cl.
CPC ..... *H01Q 1/243* (2013.01); *H01Q 1/48* (2013.01)

(58) Field of Classification Search
None
See application file for complete search history.

(56) References Cited

U.S. PATENT DOCUMENTS 8,811,922 B2 * 8/2014 Mujtaba ..... H04W 68/00 455/127.4
8,971,826 B2 3/2015 Abdul-Gaffoor et al.
9,024,823 B2 5/2015 Bevelacqua
9,084,128 B2 * 7/2015 Mujtaba ..... H04W 68/00
(Continued)

FOREIGN PATENT DOCUMENTS

JP 2012-249289 12/2012
JP 2013-528999 7/2013
(Continued)

*Primary Examiner* — Trinh V Dinh

(57) ABSTRACT

A method of improving antenna performance and an electronic device configured to improve the antenna performance are provided. The electronic device include: a housing; an antenna located inside the housing or formed as part of the housing; a radio frequency (RF) interface configured to transmit/receive wireless signals via the antenna; a groove formed inside an opening in part of the housing; an electrical connector placed inside the groove; a ground member placed inside the housing; a processor electrically connected to the RF interface and the electrical connector; and a memory electrically connected to the processor. The memory stores instructions which enable the processor to detect an external electrical connector inserted into the electrical connector, and select at least one of a plurality of electrical paths between the RF interface and the ground member, in response to at least part of the inserted external electrical connector. Various embodiments are provided.

10 Claims, 9 Drawing Sheets

(56) References Cited

U.S. PATENT DOCUMENTS

| | | | | |
|---|---|---|---|---|
| 2008/0316116 | A1* | 12/2008 | Hobson | H01Q 1/243 343/702 |
| 2011/0254638 | A1 | 10/2011 | Manssen et al. | |
| 2012/0009983 | A1* | 1/2012 | Mow | H01Q 1/243 455/575.7 |
| 2012/0119955 | A1 | 5/2012 | Milosavljevic et al. | |
| 2012/0194998 | A1* | 8/2012 | McClure | G06F 1/1626 361/679.56 |
| 2013/0140913 | A1* | 6/2013 | Inha | H03K 17/687 307/126 |
| 2014/0075210 | A1* | 3/2014 | Rich | G06F 1/1632 713/300 |
| 2015/0188230 | A1 | 7/2015 | Kim et al. | |
| 2015/0296396 | A1* | 10/2015 | Mujtaba | H04W 68/00 455/515 |
| 2016/0139640 | A1* | 5/2016 | Hijazi | G06F 1/26 361/679.31 |
| 2016/0210616 | A1* | 7/2016 | Lee | G06Q 20/3278 |

FOREIGN PATENT DOCUMENTS

| | | |
|---|---|---|
| KR | 10-1194227 | 10/2012 |
| KR | 10-2014-0133872 | 11/2014 |
| KR | 10-2015-0080944 | 7/2015 |

* cited by examiner

<701a>

<702a>

<701b>

<702b>

<701c>

<702c>

ELECTRONIC DEVICE AND METHOD OF IMPROVING ANTENNA PERFORMANCE THEREOF

CROSS-REFERENCE TO RELATED APPLICATION(S) AND CLAIM OF PRIORITY

The present application is related to and claims priority under 35 U.S.C. § 119(a) to Korean Patent Application Serial No. 10-2015-0113941, which was filed in the Korean Intellectual Property Office on Aug. 12, 2015, the entire disclosure of which is incorporated herein by reference.

TECHNICAL FIELD

Various embodiments of the present disclosure relate to an electronic device configured to improve the antenna performance and a method of improving the antenna performance by minimizing the resonance change caused by the connection of an accessory to the electronic device with a radio frequency (RF) interface.

BACKGROUND

Electronic devices, such as portable terminals, etc., have been evolving to be equipped with various functions, e.g., wireless communication functions. In order to meet users' needs requiring wireless devices based on a small form factor, electronic devices have been equipped with a wireless communication circuit including antenna components which employ small structures. In recent years, electronic devices have started to employ metallic housing from plastic injection housing. Metallic housing may affect the change in the resonant frequency of an antenna of electronic devices. In particular, when a metallic accessory is connected to an electronic device, the metallic accessory may affect a performance of radio frequency (RF). Therefore, although the electronic devices including metallic housing structures are connected with accessories, the electronic devices need to perform a wireless communication function without any interference from the accessories. To this end, the electronic devices need to be equipped with a wireless communication circuit capable of performing a smooth wireless communication function.

When electronic devices, manufactured with injected materials of synthetic resin, such as plastic, etc., are connected with accessories (e.g., a data cable, earphones, etc.), an antenna performance is relatively stable; however, when the electronic devices manufactured with metal materials are connected with metallic accessories, the electronic devices may experience a change in the resonant frequency that may decrease an RF performance.

SUMMARY

To address the above-discussed deficiencies, it is a primary object to provide a method and apparatus for minimizing the change in the resonant frequency caused by the connection of accessories and providing the user with an optimized antenna performance.

In accordance with various embodiments of the present invention, an electronic device is provided. The electronic device includes: a housing; an antenna located inside the housing or formed as part of the housing; a radio frequency (RF) interface configured to transmit/receive wireless signals via the antenna; a groove formed inside an opening in part of the housing; an electrical connector placed inside the groove; a ground member placed inside the housing; a processor electrically connected to the RF interface and the electrical connector; and a memory electrically connected to the processor. The memory stores instructions which enable the processor to: detect an external electrical connector inserted into the electrical connector; and select at least one of a plurality of electrical paths between the RF interface and the ground member, in response to at least part of the inserted external electrical connector.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
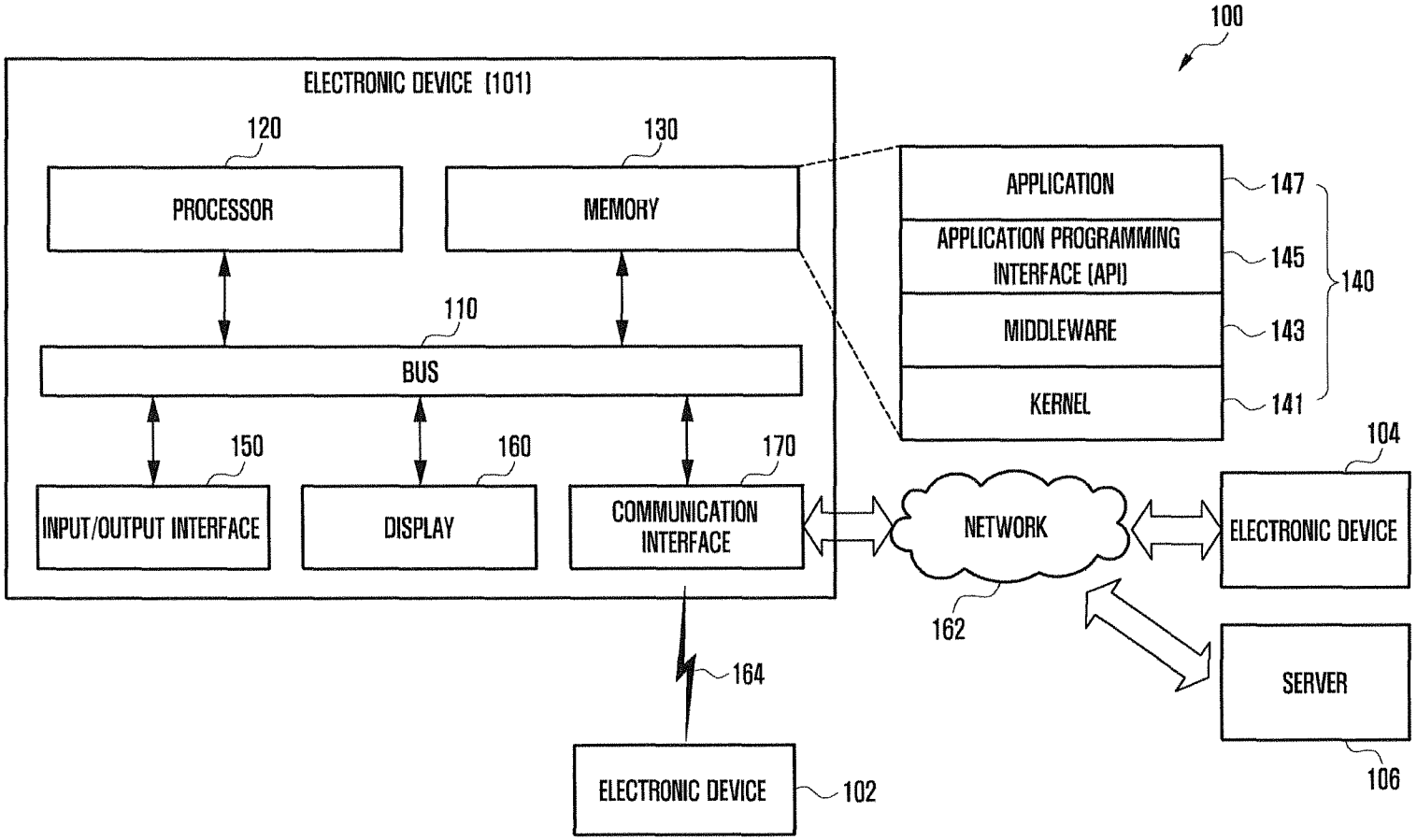
FIG. 1 illustrates a network environment including an electronic device according to embodiments of the present disclosure.

FIGS. 1 through 7C, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged electronic device. The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

As used herein, the singular forms "a", "an", and "the" are intended to include the plural forms, including "at least one", unless the content clearly indicates otherwise. "Or" means "and/or". As used herein, the term "and/or" includes any and all combinations of one or more of the associated listed items. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be understood that, although the terms "first", "second", "third", etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element", "component", "region", "layer" or "section" discussed below could be termed a second element, component, region, layer or section without departing from the teachings herein.

In this disclosure, an electronic device may be a device that involves a communication function. For example, an electronic device may be a smart phone, a tablet PC (Personal Computer), a mobile phone, a video phone, an e-book reader, a desktop PC, a laptop PC, a netbook computer, a PDA (Personal Digital Assistant), a PMP (Portable Multimedia Player), an MP3 player, a portable medical device, a digital camera, or a wearable device (e.g., an HMD (Head-Mounted Device) such as electronic glasses, electronic clothes, an electronic bracelet, an electronic necklace, an electronic appcessory, or a smart watch).

According to some embodiments, an electronic device may be a smart home appliance that involves a communication function. For example, an electronic device may be a TV, a DVD (Digital Video Disk) player, audio equipment, a refrigerator, an air conditioner, a vacuum cleaner, an oven, a microwave, a washing machine, an air cleaner, a set-top box, a TV box (e.g., Samsung HomeSync™, Apple TV™, Google TV™, etc.), a game console, an electronic dictionary, an electronic key, a camcorder, or an electronic picture frame.

According to some embodiments, an electronic device may be a medical device (e.g., MRA (Magnetic Resonance Angiography), MM (Magnetic Resonance Imaging), CT (Computed Tomography), ultrasonography, etc.), a navigation device, a GPS (Global Positioning System) receiver, an EDR (Event Data Recorder), an FDR (Flight Data Recorder), a car infotainment device, electronic equipment for ship (e.g., a marine navigation system, a gyrocompass, etc.), avionics, security equipment, or an industrial or home robot.

According to some embodiments, an electronic device may be furniture or part of a building or construction having a communication function, an electronic board, an electronic signature receiving device, a projector, or various measuring instruments (e.g., a water meter, an electric meter, a gas meter, a wave meter, etc.). An electronic device disclosed herein may be one of the above-mentioned devices or any combination thereof. As well understood by those skilled in the art, the above-mentioned electronic devices are exemplary only and not to be considered as a limitation of this disclosure.

FIG. 1 illustrates a block diagram illustrating a configuration of an electronic device according to an embodiment of the present disclosure.

Referring to FIG. 1, the electronic device 101 may include a bus 110, a processor 120, a memory 130, a user input 150, a display 160, a communication interface 170, and other similar and/or suitable components.

The bus 110 may be a circuit which interconnects the above-described elements and delivers a communication (e.g., a control message) between the above-described elements.

The processor 120 may receive commands from the above-described other elements (e.g., the memory 130, the user input 140, the display 150, the communication interface 160, etc.) through the bus 110, may interpret the received commands, and may execute calculation or data processing according to the interpreted commands.

The memory 130 may store commands or data received from the processor 120 or other elements (e.g., the user input 140, the display 150, the communication interface 160, etc.) or generated by the processor 120 or the other elements. The memory 130 may include programming modules, such as a kernel 131, middleware 132, an Application Programming Interface (API) 133, an application 134, and the like. Each of the above-described programming modules may be implemented in software, firmware, hardware, or a combination of two or more thereof.

The kernel 131 may control or manage system resources (e.g., the bus 110, the processor 120, the memory 130, etc.) used to execute operations or functions implemented by other programming modules (e.g., the middleware 132, the API 133, and the application 134). Also, the kernel 131 may provide an interface capable of accessing and controlling or managing the individual elements of the electronic device 101 by using the middleware 132, the API 133, or the application 134.

The middleware 132 may serve to go between the API 133 or the application 134 and the kernel 131 in such a manner that the API 133 or the application 134 communicates with the kernel 131 and exchanges data therewith. Also, in relation to work requests received from one or more applications 134 and/or the middleware 132, for example, may perform load balancing of the work requests by using a method of assigning a priority, in which system resources (e.g., the bus 110, the processor 120, the memory 130, etc.) of the electronic device 101 can be used, to at least one of the one or more applications 134.

The API 133 is an interface through which the application 134 is capable of controlling a function provided by the kernel 131 or the middleware 132, and may include, for example, at least one interface or function for file control, window control, image processing, character control, or the like.

The user input 150, for example, may receive a command or data as input from a user, and may deliver the received command or data to the processor 120 or the memory 130 through the bus 110. The display 160 may display a video, an image, data, or the like to the user.

The communication interface 170 may connect communication between another electronic device 102 and the electronic device 101. The communication interface 170 may support a predetermined short-range communication protocol (e.g., Wi-Fi, BlueTooth (BT), and near field communication (NFC)), or predetermined network communication 162 (e.g., the internet, a local area network (LAN), a wide area network (WAN), a telecommunication network, a cellular network, a satellite network, a plain old telephone service (POTS), or the like). Each of the electronic devices 102 and 104 may be a device which is identical (e.g., of an identical type) to or different (e.g., of a different type) from the electronic device 101. Further, the communication interface 160 may connect communication between a server 164 and the electronic device 101 via the network 162.

Figure 2:
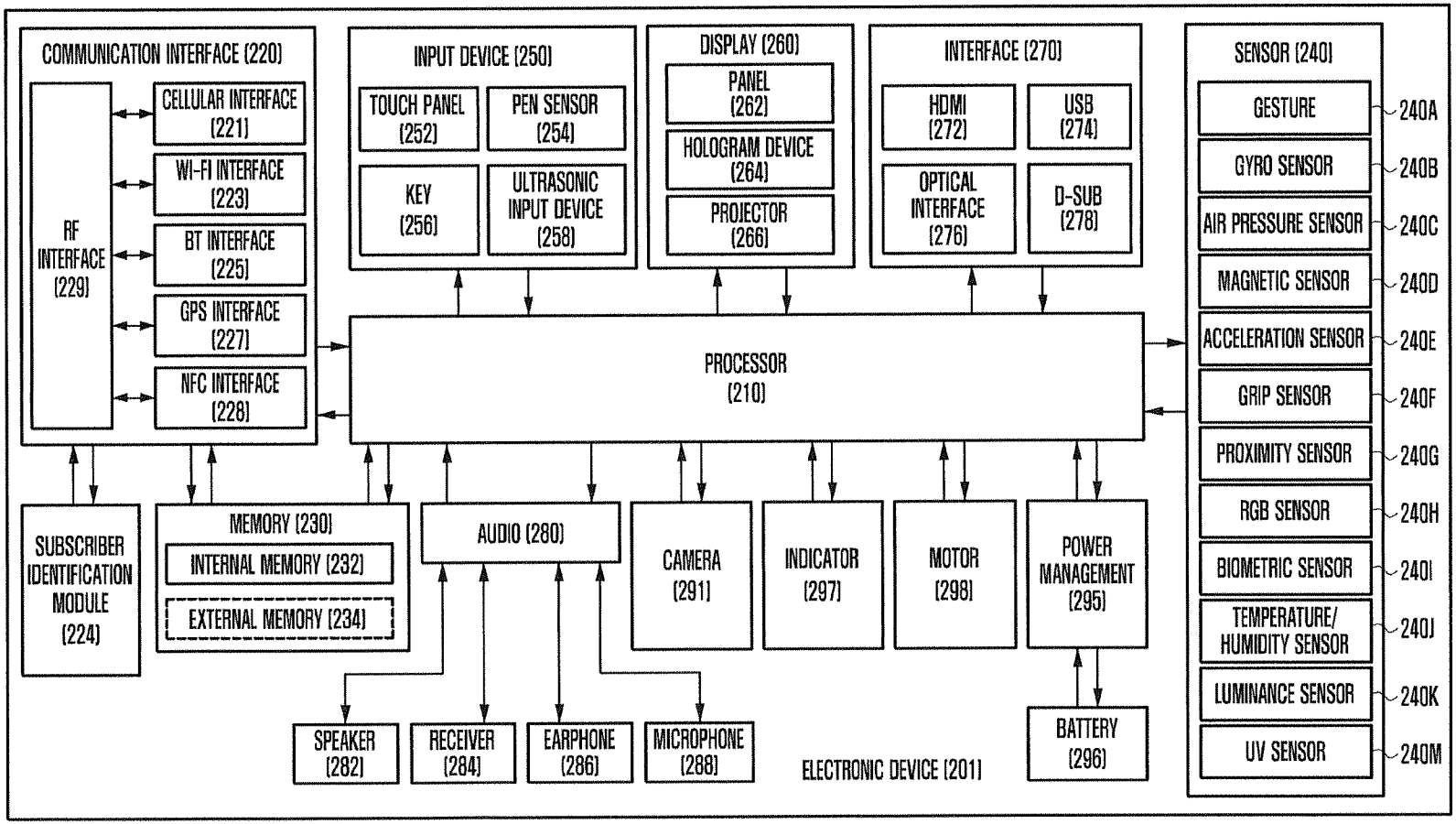
FIG. 2 illustrates a block diagram of an electronic device according to various embodiments of the present disclosure.

FIG. 2 illustrates a block diagram illustrating a configuration of hardware 200 according to an embodiment of the present disclosure.

The hardware 200 may be, for example, the electronic device 101 illustrated in FIG. 1.

Referring to FIG. 2, the hardware 200 may include one or more processors 210, a Subscriber Identification Module (SIM) card 214, a memory 220, a communication interface 230, a sensor 240, a user input 250, a display 260, an interface 270, an audio coder/decoder (codec) 280, a camera 291, a power management 295, a battery 296, an indicator 297, a motor 298 and any other similar and/or suitable components.

The electronic device 201 according to various embodiments of the present disclosure is capable of including a housing, a groove formed inside an opening formed in part of the housing, an electrical connector placed inside the groove, a ground member placed inside the housing, and a switch for selecting at least one of a plurality of electrical paths based on a switch driving signal transmitted via at least one general purpose input/output pin. The processor 210 (e.g., the processor 120) may include one or more application processors (APs) 211, or one or more communication processors (CPs) 213. The processor 210 may be, for example, the processor 120 illustrated in FIG. 1. The AP 211 and the CP 213 are illustrated as being included in the processor 210 in FIG. 2, but may be included in different Integrated Circuit (IC) packages, respectively. According to an embodiment of the present disclosure, the AP 211 and the CP 213 may be included in one IC package.

The AP 211 may execute an operating system (OS) or an application program, and thereby may control multiple hardware or software elements connected to the AP 211 and may perform processing of and arithmetic operations on various data including multimedia data. The AP 211 may be implemented by, for example, a system on chip (SoC). According to an embodiment of the present disclosure, the processor 210 may further include a graphical processing unit (GPU) (not illustrated).

The CP 213 may manage a data line and may convert a communication protocol in the case of communication between the electronic device (e.g., the electronic device 101) including the hardware 200 and different electronic devices connected to the electronic device through the network. The CP 213 may be implemented by, for example, a SoC. According to an embodiment of the present disclosure, the CP 213 may perform at least some of multimedia control functions. The CP 213, for example, may distinguish and authenticate a terminal in a communication network by using a subscriber identification module (e.g., the SIM card 214). Also, the CP 213 may provide the user with services, such as a voice telephony call, a video telephony call, a text message, packet data, and the like.

Further, the CP 213 may control the transmission and reception of data by the communication interface 230. In FIG. 2, the elements such as the CP 213, the power management 295, the memory 220, and the like are illustrated as elements separate from the AP 211. However, according to an embodiment of the present disclosure, the AP 211 may include at least some (e.g., the CP 213) of the above-described elements.

According to an embodiment of the present disclosure, the AP 211 or the CP 213 may load, to a volatile memory, a command or data received from at least one of a non-volatile memory and other elements connected to each of the AP 211 and the CP 213, and may process the loaded command or data. Also, the AP 211 or the CP 213 may store, in a non-volatile memory, data received from or generated by at least one of the other elements.

The SIM card 214 may be a card implementing a subscriber identification module, and may be inserted into a slot formed in a particular portion of the electronic device 101. The SIM card 214 may include unique identification information (e.g., integrated circuit card identifier (ICCID)) or subscriber information (e.g., international mobile subscriber identity (IMSI)).

The memory 220 may include an internal memory 222 and an external memory 224. The memory 220 may be, for example, the memory 130 illustrated in FIG. 1. The internal memory 222 may include, for example, at least one of a volatile memory (e.g., a dynamic rAM (DRAM), a static rAM (SRAM), a synchronous dynamic RAM (SDRAM), etc.), and a non-volatile memory (e.g., a one time programmable ROM (OTPROM), a programmable ROM (PROM), an erasable and programmable ROM (EPROM), an electrically erasable and programmable ROM (EEPROM), a mask ROM, a flash ROM, a Not AND (NAND) flash memory, a Not OR (NOR) flash memory, etc.). According to an embodiment of the present disclosure, the internal memory 222 may be in the form of a solid state drive (SSD). The external memory 224 may further include a flash drive, for example, a compact flash (CF), a Secure Digital (SD), a micro-secure digital (Micro-SD), a mini-secure digital (Mini-SD), an extreme Digital (xD), a memory stick, or the like.

In various embodiments of the present disclosure, the memory 230 stores instructions which enable the processor 210 to: detect an external electrical connector inserted into the electrical connector; and select at least one of a plurality of electrical paths between the RF interface and the ground member, in response to at least part of the inserted external electrical connector.

In various embodiments of the present disclosure, the memory 230 stores instructions which enable the processor 210 to select: a first path of the plurality of electrical paths, when the external electrical connector is not inserted to the electrical connector; and a second path of the plurality of electrical paths, when the external electrical connector is inserted to the electrical connector.

In various embodiments of the present disclosure, the memory 230 stores instructions which enable the processor 210 to switch a first electrical path of the plurality of electrical paths to a second electrical path, when the signals of the frequency are transmitted/received.

In various embodiments of the present disclosure, the memory 230 stores a switching table containing information regarding a switch driving signal corresponding to at least one external electrical connector, according to frequency bands.

In various embodiments of the present disclosure, the memory 230 stores the instructions which enable the processor 210 to: create a switch driving signal corresponding to the detected external electrical connector, based on a stored switching table; and select at least one of the plurality of electrical paths, based on the switch driving signal transmitted to the switch via at least one general purpose input/output pin.

The sensor 240 may include, for example, at least one of a gesture sensor 240A, a gyro sensor 240B, an atmospheric pressure sensor 240C, a magnetic sensor 240D, an acceleration sensor 240E, a grip sensor 240F, a proximity sensor 240G, a red, green and blue (RGB) sensor 240H, a biometric sensor 240I, a temperature/humidity sensor 240J, an illuminance sensor 240K, and a ultra violet (UV) sensor 240M. The sensor 240 may measure a physical quantity or may sense an operating state of the electronic device 101, and may convert the measured or sensed information to an electrical signal. Additionally/alternatively, the sensor 240 may include, for example, an e-nose sensor (not illustrated), an electromyography (EMG) sensor (not illustrated), an electroencephalogram (EEG) sensor (not illustrated), an electrocardiogram (ECG) sensor (not illustrated), a fingerprint sensor (not illustrated), and the like. Additionally or alternatively, the sensor 240 may include, for example, an E-nose sensor (not illustrated), an EMG sensor (not illustrated), an EEG sensor (not illustrated), an ECG sensor (not illustrated), a fingerprint sensor, and the like. The sensor 240 may further include a control circuit (not illustrated) for controlling one or more sensors included therein.

The user input 250 may include a touch panel 252, a pen sensor 254 (e.g., a digital pen sensor), keys 256, and an ultrasonic input unit 258. The user input 250 may be, for example, the user input 140 illustrated in FIG. 1. The touch panel 252 may recognize a touch input in at least one of, for example, a capacitive scheme, a resistive scheme, an infrared scheme, and an acoustic wave scheme. Also, the touch panel 252 may further include a controller (not illustrated). In the capacitive type, the touch panel 252 is capable of recognizing proximity as well as a direct touch. The touch panel 252 may further include a tactile layer (not illustrated). In this event, the touch panel 252 may provide a tactile response to the user.

The pen sensor 254 (e.g., a digital pen sensor), for example, may be implemented by using a method identical or similar to a method of receiving a touch input from the user, or by using a separate sheet for recognition. For example, a key pad or a touch key may be used as the keys 256. The ultrasonic input unit 258 enables the terminal to sense a sound wave by using a microphone (e.g., a microphone 288) of the terminal through a pen generating an ultrasonic signal, and to identify data. The ultrasonic input unit 258 is capable of wireless recognition. According to an embodiment of the present disclosure, the hardware 200 may receive a user input from an external device (e.g., a network, a computer, or a server), which is connected to the communication interface 230, through the communication interface 230.

The display 260 may include a panel 262 or a hologram 264. The display 260 may be, for example, the display 150 illustrated in FIG. 1. The panel 262 may be, for example, a liquid crystal display (LCD) and an active matrix organic light emitting diode (AM-OLED) display, and the like. The panel 262 may be implemented so as to be, for example, flexible, transparent, or wearable. The panel 262 may include the touch panel 252 and one module. The hologram 264 may display a three-dimensional image in the air by using interference of light. According to an embodiment of the present disclosure, the display 260 may further include a control circuit for controlling the panel 262 or the hologram 264.

The interface 270 may include, for example, a high-definition Multimedia Interface (HDMI) 272, a universal serial bus (USB) 274, a projector 276, and a D-subminiature (D-sub) 278. Additionally or alternatively, the interface 270 may include, for example, SD/multi-media card (MMC) (not illustrated) or infrared data association (IrDA) (not illustrated).

The audio codec 280 may bidirectionally convert between a voice and an electrical signal. The audio codec 280 may convert voice information, which is input to or output from the audio codec 280, through, for example, a speaker 282, a receiver 284, an earphone 286, the microphone 288 or the like.

The camera 291 may capture an image and a moving image. According to an embodiment, the camera 291 may include one or more image sensors (e.g., a front lens or a back lens), an image signal processor (ISP) (not illustrated), and a flash LED (not illustrated).

The power management 295 may manage power of the hardware 200. Although not illustrated, the power management 295 may include, for example, a power management integrated circuit (PMIC), a charger integrated circuit (IC), or a battery fuel gauge.

The PMIC may be mounted to, for example, an IC or a SoC semiconductor. Charging methods may be classified into a wired charging method and a wireless charging method. The charger IC may charge a battery, and may prevent an overvoltage or an overcurrent from a charger to the battery. According to an embodiment of the present disclosure, the charger IC may include a charger IC for at least one of the wired charging method and the wireless charging method. Examples of the wireless charging method may include a magnetic resonance method, a magnetic induction method, an electromagnetic method, and the like. Additional circuits (e.g., a coil loop, a resonance circuit, a rectifier, etc.) for wireless charging may be added in order to perform the wireless charging.

The battery fuel gauge may measure, for example, a residual quantity of the battery 296, or a voltage, a current or a temperature during the charging. The battery 296 may supply power by generating electricity, and may be, for example, a rechargeable battery.

The indicator 297 may indicate particular states of the hardware 200 or a part (e.g., the AP 211) of the hardware 200, for example, a booting state, a message state, a charging state and the like. The motor 298 may convert an electrical signal into a mechanical vibration. The processor 210 may control the sensor 240.

Although not illustrated, the hardware 200 may include a processing unit (e.g., a GPU) for supporting a module TV. The processing unit for supporting a module TV may process media data according to standards such as, for example, digital multimedia broadcasting (DMB), digital video broadcasting (DVB), media flow, and the like. Each of the above-described elements of the hardware 200 according to an embodiment of the present disclosure may include one or more components, and the name of the relevant element may change depending on the type of electronic device. The hardware 200 according to an embodiment of the present disclosure may include at least one of the above-described elements. Some of the above-described elements may be omitted from the hardware 200, or the hardware 200 may further include additional elements. Also, some of the elements of the hardware 200 according to an embodiment of the present disclosure may be combined into one entity, which may perform functions identical to those of the relevant elements before the combination.

The term "module" used in the present disclosure may refer to, for example, a unit including one or more combinations of hardware, software, and firmware. The "module" may be interchangeable with a term, such as "unit," "logic," "logical block," "component," "circuit," or the like. The "module" may be a minimum unit of a component formed as one body or a part thereof. The "module" may be a minimum unit for performing one or more functions or a part thereof. The "module" may be implemented mechanically or electronically. For example, the "module" according to an embodiment of the present disclosure may include at least one of an application-specific integrated circuit (ASIC) chip, a field-programmable gate array (FPGA), and a programmable-logic device for performing certain operations which have been known or are to be developed in the future.

Figure 3:
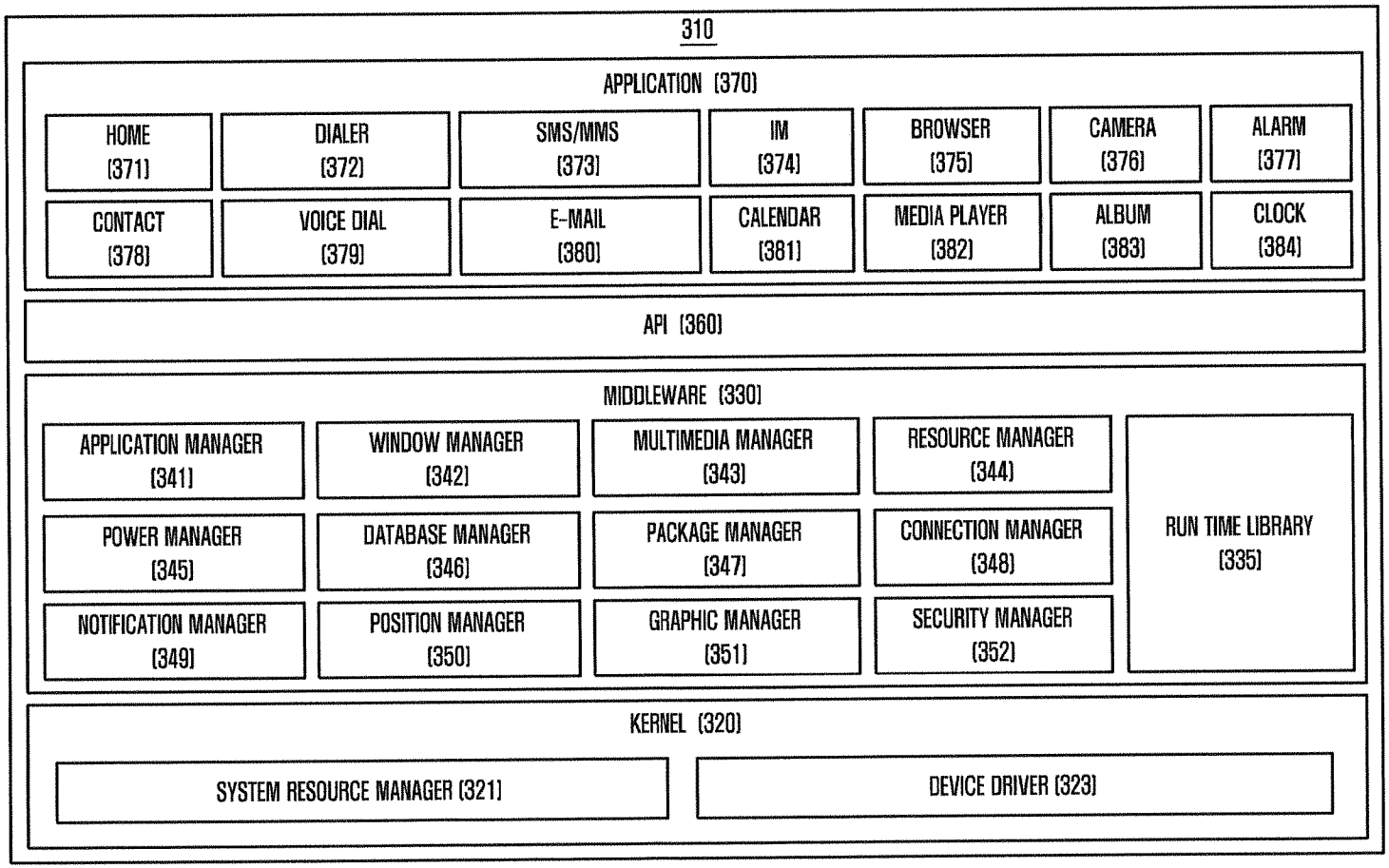
FIG. 3 illustrates a block diagram of a program module according to various embodiments of the present disclosure.

FIG. 3 illustrates a block diagram illustrating a configuration of a programming module 300 according to an embodiment of the present disclosure.

The programming module 300 may be included (or stored) in the electronic device 100 (e.g., the memory 130) or may be included (or stored) in the electronic device 200 (e.g., the memory 230) illustrated in FIG. 1. At least a part of the programming module 300 may be implemented in software, firmware, hardware, or a combination of two or more thereof. The programming module 300 may be implemented in hardware (e.g., the hardware 200), and may include an OS controlling resources related to an electronic device (e.g., the electronic device 100) and/or various applications (e.g., an application 370) executed in the OS. For example, the OS may be Android, iOS, Windows, Symbian, Tizen, Bada, and the like.

Referring to FIG. 3, the programming module 300 may include a kernel 310, a middleware 330, an API 360, and/or the application 370.

The kernel 310 (e.g., the kernel 131) may include a system resource manager 311 and/or a device driver 312. The system resource manager 311 may include, for example, a process manager (not illustrated), a memory manager (not illustrated), and a file system manager (not illustrated). The system resource manager 311 may perform the control, allocation, recovery, and/or the like of system resources. The device driver 312 may include, for example, a display driver (not illustrated), a camera driver (not illustrated), a Bluetooth driver (not illustrated), a shared memory driver (not illustrated), a USB driver (not illustrated), a keypad driver (not illustrated), a Wi-Fi driver (not illustrated), and/or an audio driver (not illustrated). Also, according to an embodiment of the present disclosure, the device driver 312 may include an inter-process communication (IPC) driver (not illustrated).

The programming module 300 may be included (or stored) in the electronic device 101 (e.g., the memory 130) or may be included (or stored) in the electronic device 200 (e.g., the memory 230) illustrated in FIG. 1. At least a part of the programming module 300 may be implemented in software, firmware, hardware, or a combination of two or more thereof. The programming module 300 may be implemented in hardware (e.g., the hardware 200), and may include an OS controlling resources related to an electronic device (e.g., the electronic device 101) and/or various applications (e.g., an application 370) executed in the OS. For example, the OS may be Android, iOS, Windows, Symbian, Tizen, Bada, and the like.

The runtime library 335 may include, for example, a library module used by a complier, in order to add a new function by using a programming language during the execution of the application 370. According to an embodiment of the present disclosure, the runtime library 335 may perform functions which are related to input and output, the management of a memory, an arithmetic function, and/or the like.

The application manager 341 may manage, for example, a life cycle of at least one of the applications 370. The window manager 342 may manage GUI resources used on the screen. The multimedia manager 343 may detect a format used to reproduce various media files and may encode or decode a media file through a codec appropriate for the relevant format. The resource manager 344 may manage resources, such as a source code, a memory, a storage space, and/or the like of at least one of the applications 370.

The power manager 345 may operate together with a basic input/output system (BIOS), may manage a battery or power, and may provide power information and the like used for an operation. The database manager 346 may manage a database in such a manner as to enable the generation, search and/or change of the database to be used by at least one of the applications 370. The package manager 347 may manage the installation and/or update of an application distributed in the form of a package file.

The connectivity manager 348 may manage a wireless connectivity such as, for example, Wi-Fi and Bluetooth. The notification manager 349 may display or report, to the user, an event such as an arrival message, an appointment, a proximity alarm, and the like in such a manner as not to disturb the user. The location manager 350 may manage location information of the electronic device. The graphic manager 351 may manage a graphic effect, which is to be provided to the user, and/or a user interface related to the graphic effect. The security manager 352 may provide various security functions used for system security, user authentication, and the like. According to an embodiment of the present disclosure, when the electronic device (e.g., the electronic device 101) has a telephone function, the middleware 330 may further include a telephony manager (not illustrated) for managing a voice telephony call function and/or a video telephony call function of the electronic device.

The middleware 330 may generate and use a new middleware module through various functional combinations of the above-described internal element modules. The middleware 330 may provide modules specialized according to types of OS s in order to provide differentiated functions. Also, the middleware 330 may dynamically delete some of the existing elements, or may add new elements. Accordingly, the middleware 330 may omit some of the elements described in the various embodiments of the present disclosure, may further include other elements, or may replace the some of the elements with elements, each of which performs a similar function and has a different name.

The API 360 (e.g., the API 133) is a set of API programming functions, and may be provided with a different configuration according to an OS. In the case of Android or iOS, for example, one API set may be provided to each platform. In the case of Tizen, for example, two or more API sets may be provided to each platform.

The applications 370 (e.g., the applications 134) may include, for example, a preloaded application and/or a third party application. The applications 370 (e.g., the applications 134) may include, for example, a home application 371, a dialer application 372, a short message service (SMS)/multimedia message service (MMS) application 373, an instant message (IM) application 374, a browser application 375, a camera application 376, an alarm application 377, a contact application 378, a voice dial application 379, an electronic mail (e-mail) application 380, a calendar application 381, a media player application 382, an album application 383, a clock application 384, and any other suitable and/or similar application.

At least a part of the programming module 300 may be implemented by instructions stored in a non-transitory computer-readable storage medium. When the instructions are executed by one or more processors (e.g., the one or more processors 210), the one or more processors may perform functions corresponding to the instructions. The non-transitory computer-readable storage medium may be, for example, the memory 220. At least a part of the programming module 300 may be implemented (e.g., executed) by, for example, the one or more processors 210. At least a part of the programming module 300 may include, for example, a module, a program, a routine, a set of instructions, and/or a process for performing one or more functions.

Names of the elements of the programming module (e.g., the programming module 300) according to an embodiment of the present disclosure may change depending on the type of OS. The programming module according to an embodiment of the present disclosure may include one or more of the above-described elements. Alternatively, some of the above-described elements may be omitted from the programming module. Alternatively, the programming module may further include additional elements. The operations performed by the programming module or other elements according to an embodiment of the present disclosure may be processed in a sequential method, a parallel method, a repetitive method, or a heuristic method. Also, some of the operations may be omitted, or other operations may be added to the operations.

Figure 4:
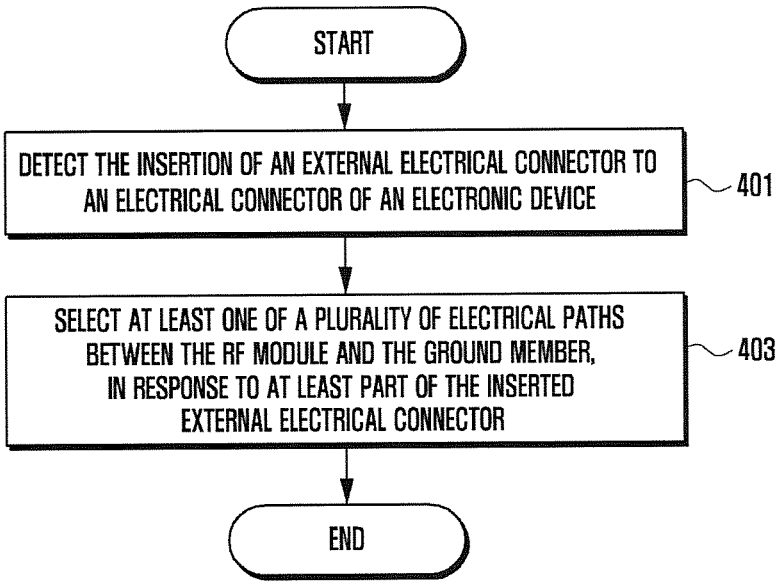
FIG. 4 illustrates a flow diagram that describes a method for an electronic device to select at least one of a plurality of electrical paths between a radio frequency (RF) interface and a ground member, in response to the connection of an external electrical connector to the electronic device, according to various embodiments of the present disclosure.

FIG. 4 illustrates a flow diagram that describes a method for an electronic device 201 shown in FIG. 2 to select at least one of a plurality of electrical paths between a radio frequency (RF) interface and a ground member, in response to the connection of an external electrical connector to the electronic device, according to various embodiments of the present disclosure.

Figure 5:
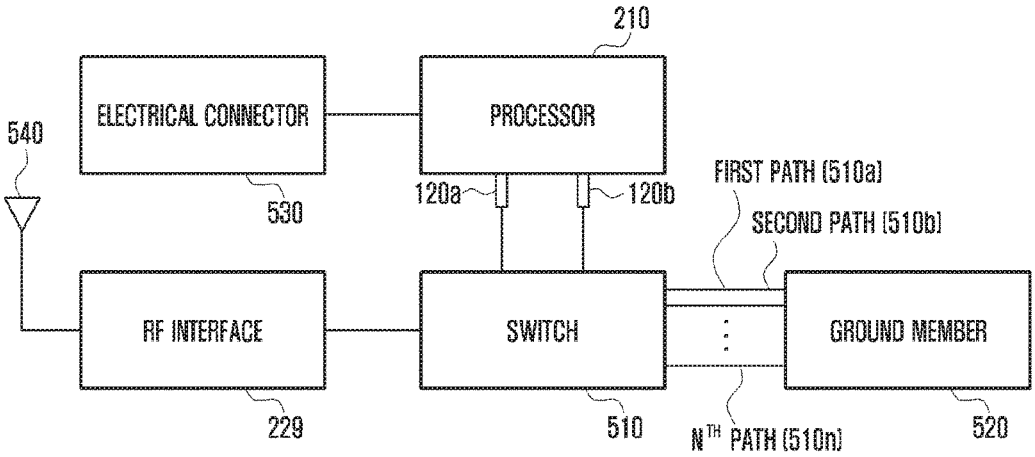
FIG. 5 illustrates a block diagram illustrating a case where an electronic device 201 selects at least one of a plurality of electrical paths between a radio frequency (RF) interface and a ground member via a switch according to various embodiments of the present disclosure.
Figure 6:
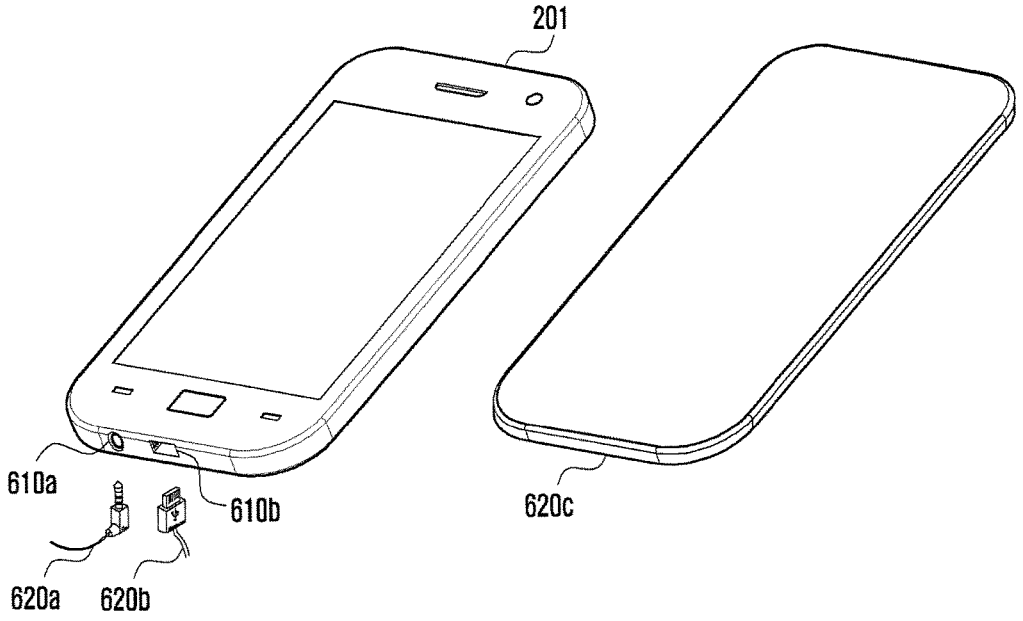
FIG. 6 illustrates a diagram that describes a case where an electronic device 201 detects an external electrical connector of various accessories according to various embodiments of the present disclosure.

The electronic device 201 is capable of detecting an external electrical connector made of metallic material inserted into an electrical connector in operation 401. The external electrical connector may be an audio jack such as an earphone jack, a USB connector, or a metallic accessory. For example, as shown in FIG. 5, the electronic device 201 is capable of including a groove formed in an opening formed in part of the housing. The processor 210 of the electronic device 201 is capable of detecting whether an external electrical connector of an accessory is inserted into the electrical connector 530 placed inside the groove. The electronic device 201 is capable of detecting an external electrical connector, e.g., an audio jack such as an earphone jack, a USB connector, etc., when the electronic device 201 is directly inserted into the electrical connector. Alternatively, the electronic device 201 is capable of detecting a metallic accessory, such as the protective case, when the metallic accessory is installed to the electronic device 201. For example, as shown in FIG. 6, the electronic device 201 may detect the insertion of an earphone jack 620*a* via the first electrical connector 610*a* and the insertion of a USB connector 620*b* via the second electrical connector 620*a*. The electronic device 201 may also detect the installation of a metallic accessory 620*c* thereto, via a third electrical connector (not shown). It should be understood that the present disclosure is not limited to the embodiments; however, the electronic device 201 may also detect the insertion of various types of external electrical connectors as accessories.

The electronic device 201 is capable of selecting at least one of a plurality of electrical paths between the RF interface 229 and the ground member, in response to at least part of the inserted external electrical connector in operation 403. The RF interface 229 can be connected to the antenna 540.

In various embodiments of the present disclosure, the electronic device 201 is capable of creating a switch driving signal corresponding to a type of external electrical connector. For example, when the electronic device 201 detects the insertion of an earphone jack while performing a communication function at a band of 700 MHz, the electronic device 201 may create a first switch driving signal. When the electronic device 201 detects the insertion of a USB connector while performing a communication function at a band of 700 MHz, the electronic device 201 may create a second switch driving signal. Alternatively, when the electronic device 201 detects the insertion of an earphone jack while performing a communication function at a band of 850 MHz, the electronic device 201 may create a third switch driving signal. When the electronic device 201 detects the insertion of a USB connector while performing a communication function at a band of 850 MHz, the electronic device 201 may create a fourth switch driving signal. The electronic device 201 is capable of creating a switching table containing information regarding a switch driving signal corresponding to at least one external electrical connector according to frequency bands, and storing the switching table in the memory 230. A detailed description regarding the switching table will be explained later referring to the following table 1.

In various embodiments of the present disclosure, the electronic device 201 is capable of creating a switch driving signal corresponding to the detected external electrical connector, based on a stored switching table. The processor 210 is capable of transmitting the created switch driving signal to a switch via a plurality of general purpose input/output (GPIO) pins. The switch switches between a plurality of electrical paths between the RF interface 229 and the ground member. The switch module is driven by a switch driving signal transmitted via a plurality of GPIO pins. The electronic device 201 is capable of selecting at least one of a plurality of electrical paths, based on a switch driving signal which is transmitted to the switch module via at least one GPIO pin. For example, as shown in FIG. 5, when the processor 210 detects the insertion of an external electrical connector to the electrical connector, the electronic device is capable of creating a switch driving signal corresponding to the detected external electrical connector and transmitting the created switch driving signal to the switch module 510 via a first GPIO pin 210*a* and a second GPIO pin 210*b*. The electronic device 201 is capable of selecting at least one of a plurality of electrical paths between the RF interface 229 and the ground member 520, according to the operation of the switch module 510. For example, as shown in FIG. 5, the electronic device 201 may select a first path 510*a* through a first switch driving signal, a second path 510*b* through a second switch driving signal, and an Nth path 510*n* through an Nth switch driving signal.

In various embodiments of the present disclosure, the electronic device 201 may select: a first path of the plurality of electrical paths, when the external electrical connector is not inserted to the electrical connector; and a second path of the plurality of electrical paths, when the external electrical connector is inserted to the electrical connector.

TABLE 1

| | First GPIO terminal | Second GPIO terminal | Use frequency band | Switch status |
|---|---|---|---|---|
| First switch driving signal | High | High | 700 MHz | First path selected |
| Second switch driving signal | Low | Low | 700 MHz | Second path selected |
| Third switch driving signal | Low | High | 850 MHz | Third path selected |

For example, referring to table 1, when the electronic device 201 needs to perform a communication function at 700 MHz and has not detected the insertion of the external electrical connector, the electronic device 201 transmits a first switch driving signal from first and second GPIO terminals, which are in a logical high state, to the switch module, so that the switch module selects a first path according to the first switch driving signal. Therefore, the electronic device 201 performs a communication function via the first path. In addition, when the electronic device 201 detects the insertion of an external electrical connector while performing a communication function at 700 MHz, the electronic device 201 transmits a second switch driving signal corresponding to the detected external electrical connector from first and second GPIO terminals, which are in a logical low state, to the switch module, so that the switch module selects a second path according to the second switch driving signal. Therefore, the electronic device 201 performs a communication function via the second path. The electrical length of the first path when the external electrical connector is not inserted to the electrical connector may differ from that of the second path when the external electrical connector is inserted to the electrical connector. For example, the electrical length of the first path may be greater than that of the second path. In addition, the first path when the external electrical connector is not inserted to the electrical connector may include an inductance of a first magnitude. The second path when the external electrical connector is inserted to the electrical connector may include an inductance of a second magnitude. The first magnitude of inductance may be greater than the second magnitude of inductance.

In various embodiments of the present disclosure, the electronic device 201 is capable of creating a switch driving signal corresponding to a frequency band, based on a stored switching table. For example, referring to table 1, when the electronic device 201 needs to perform a communication function at 850 MHz and has not detected the insertion of an external electrical connector, the electronic device 201 transmits a third switch driving signal from a first GPIO terminal in a logical low state and a second GPIO terminal in a logical high state to the switch module, so that the switch module selects a third path according to the third switch driving signal. Therefore, the electronic device 201 performs a communication function via the third path.

In various embodiments of the present disclosure, the electronic device 201 is capable of switching a first electrical path of the plurality of electrical paths to a second electrical path, when the signals less than or equal to a frequency of 1 GHz are transmitted/received. The RF interface may be configured to perform transmission/reception of signals less than or equal to a frequency of 1 GHz. For example, in a state where the electronic device 201 is performing a communication function via a first path at a frequency band of 700 MHz without the connection of an external electrical connector, when the electronic device 201 detects the insertion of an external electrical connector, the electronic device 201 allows the switch module to switch the first path to a second path. As an another example, in a state where the electronic device 201 is performing a communication function via a first path at a frequency band of 700 MHz, the electronic device 201 may switch the frequency band from 700 MHz to 850 MHz. In this case, the electronic device 201 allows the switch module to switch the first path to a second path. It should be understood that the present disclosure is not limited to the embodiments. That is, the electronic device 201 is capable of creating switch driving signals corresponding to external electrical connectors detected according to frequency bands, and selecting at least one of a plurality of electrical paths between the RF interface and the ground member, based on the created switch driving signal.

Figure 7A:
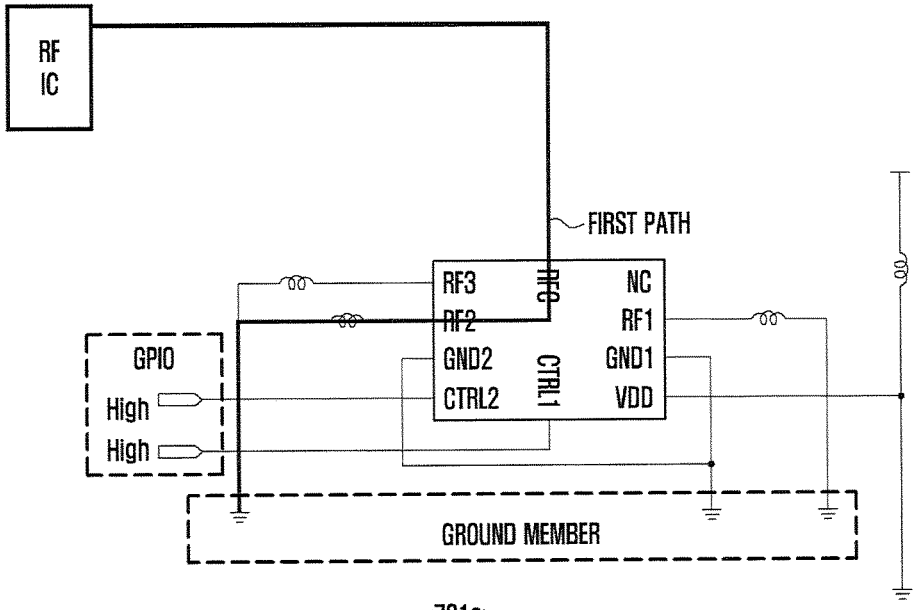
FIG. 7A illustrates a circuit diagram operated by a first switch driving signal in a switching table of table 1 for an electronic device and a voltage standing wave ratio (VSWF) graph of an antenna according to various embodiments of the present disclosure.
Figure 7A:
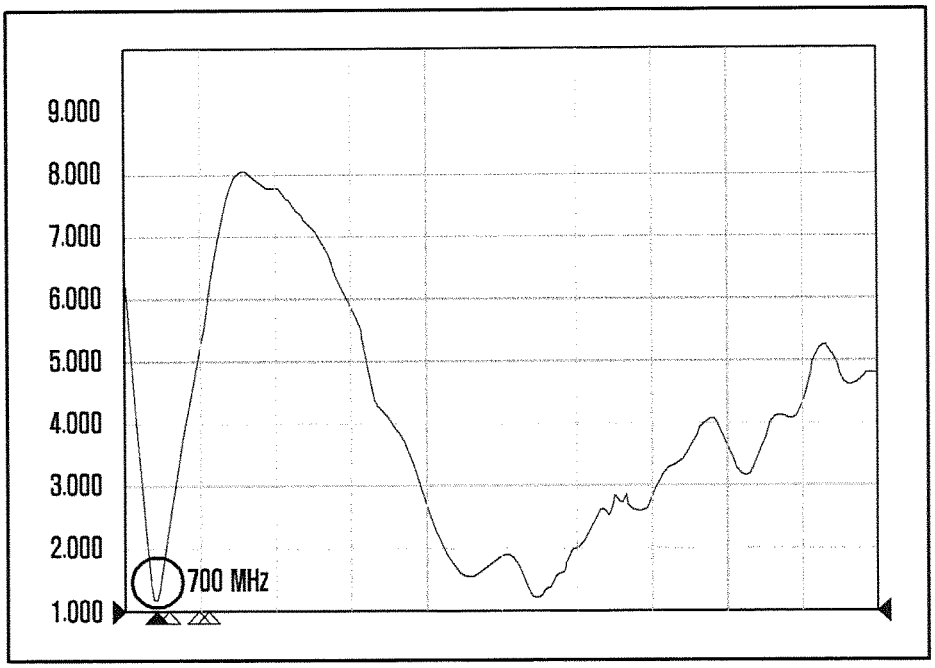

FIG. 7A illustrates a circuit diagram operated by a first switch driving signal in a switching table of table 1 for an electronic device 201, and a voltage standing wave ratio (VSWF) graph of an antenna, according to various embodiments of the present disclosure.

Referring to diagram <701*a*> of FIG. 7A, when the electronic device 201 does not detect the insertion of the external electrical connector while performing a wireless communication function at a frequency band of 700 MHz, the electronic device 201 transmits a first switch driving signal from first and second GPIO terminals, which are in a logical high state, to the switch module, so that the switch module selects a first path of a plurality of electrical paths between the RF interface and the ground member, according to the first switch driving signal. Therefore, the electronic device 201 performs a wireless communication function via the first path.

When the electronic device 201 needs to perform a wireless communication function at a frequency band of 700 MHz and has not detected the insertion of the external electrical connector, the electronic device 201 is capable of selecting a first path, based on a stored switching table, according to the circuit diagram <701*a*>, and performing a wireless communication function via the first path. In this case, as shown in a graph <702*a*> of FIG. 7A, the frequency resonance is optimized at a frequency band of 700 MHz. In the graph, the horizontal axis represents a frequency band and the vertical axis represents the VSWR value. The smaller the VSWR value, the better the antenna performance at a corresponding frequency band.

Figure 7B:
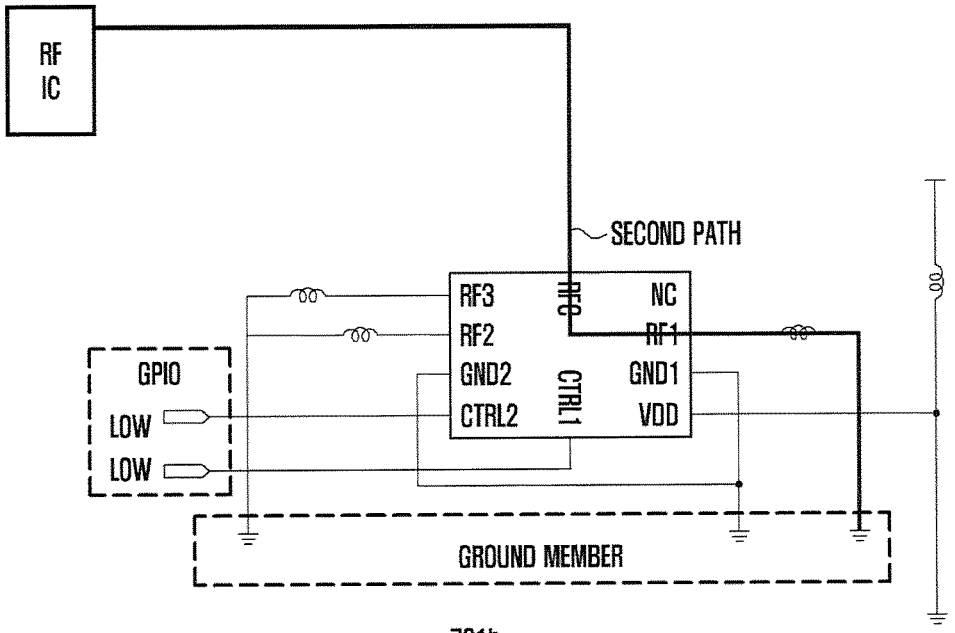
FIG. 7B illustrates a circuit diagram operated by a second switch driving signal in a switching table of table 1 for an electronic device and a voltage standing wave ratio (VSWF) graph of an antenna according to various embodiments of the present disclosure.
Figure 7B:
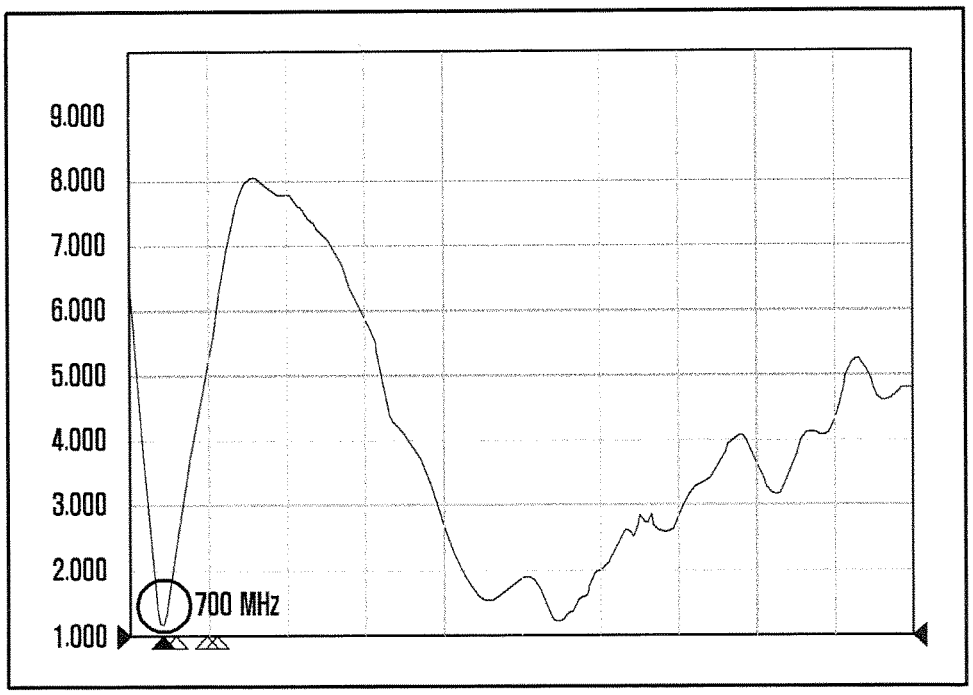

FIG. 7B illustrates a circuit diagram operated by a second switch driving signal in a switching table of table 1 for an electronic device 201, and a voltage standing wave ratio (VSWF) graph of an antenna, according to various embodiments of the present disclosure.

Referring to diagram <701*b*> of FIG. 7B, when the electronic device 201 detects the insertion of an external electrical connector while performing a wireless communication function at a frequency band of 700 MHz, the electronic device 201 transmits a second switch driving signal corresponding to the detected external electrical connector from first and second GPIO terminals, which are in a logical low state, to the switch module, so that the switch module selects a second path of a plurality of electrical paths between the RF interface and the ground member, according to the second switch driving signal. Therefore, the electronic device 201 performs a wireless communication function via the second path.

When the electronic device 201 has detected the insertion of an external electrical connector while performing a wireless communication function at a frequency band of 700 MHz, the electronic device 201 is capable of selecting a second path, based on a stored switching table, according to the circuit diagram <701*b*>, and performing a wireless communication function via the second path. In this case, as shown in a graph <702*b*> of FIG. 7B, the frequency resonance is optimized at a frequency band of 700 MHz. The electrical length of the first path shown in FIG. 7A may differ from that of the second path shown in FIG. 7B. For example, the electrical length of the first path may be greater than that of the second path. In addition, the first path may include an inductance of a first magnitude, and the second path may include an inductance of a second magnitude. The first magnitude of inductance may be greater than the second magnitude of inductance. Therefore, as described above referring to FIG. 7B, although the electronic device 201 is connected with an external electrical connector, the electronic device 201 is capable of minimizing the change in the frequency resonance and providing an optimum antenna performance.

Figure 7C:
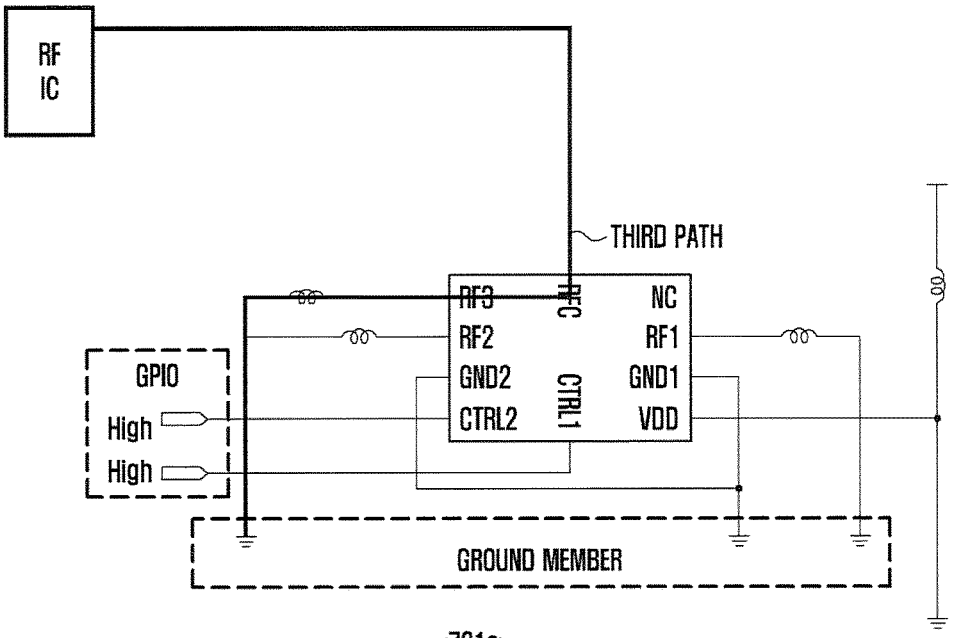
FIG. 7C illustrates a circuit diagram operated by a third switch driving signal in a switching table of table 1 for an electronic device and a voltage standing wave ratio (VSWF) graph of an antenna according to various embodiments of the present disclosure.
Figure 7C:
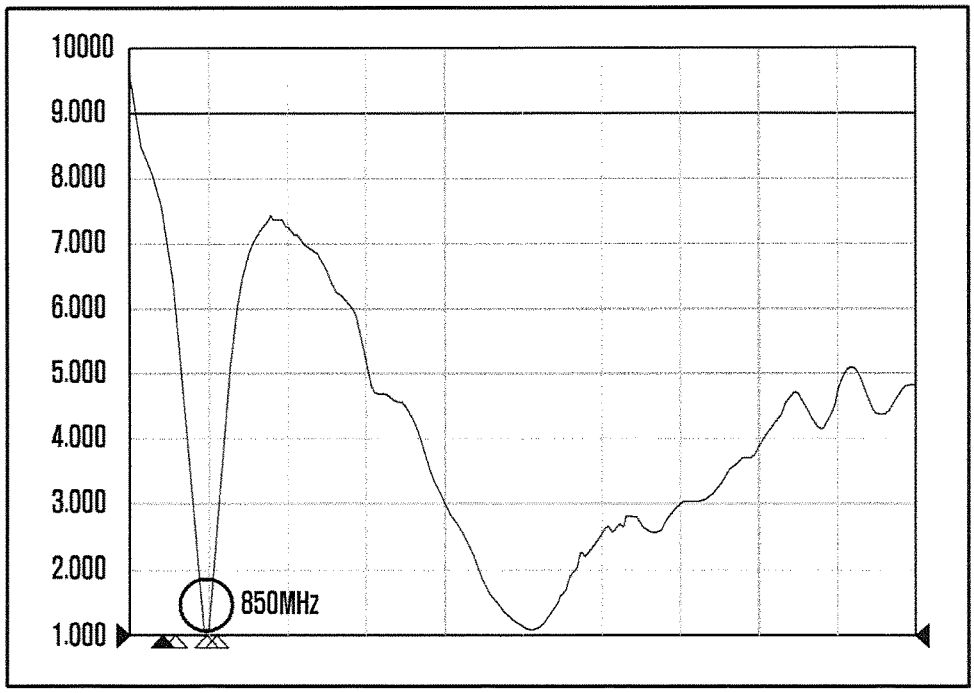

FIG. 7C illustrates a circuit diagram operated by a third switch driving signal in a switching table of table 1 for an electronic device 201, and a voltage standing wave ratio (VSWF) graph of an antenna, according to various embodiments of the present disclosure.

Referring to diagram <701*c*> of FIG. 7C, when the electronic device 201 needs to perform a wireless communication function at a frequency band of 850 MHz and has not detected the insertion of an external electrical connector, the electronic device 201 transmits a third switch driving signal from a first GPIO terminal in a logical low state and a second GPIO terminal in a logical high state to the switch module, so that the switch module selects a third path of a plurality of electrical paths between the RF interface and the ground member, according to the third switch driving signal. Therefore, the electronic device 201 performs a wireless communication function via the third path.

When the electronic device 201 has not detected the insertion of an external electrical connector while performing a wireless communication function at a frequency band of 850 MHz, the electronic device 201 is capable of selecting a third path, based on a stored switching table, according to the circuit diagram <701*c*>, and performing a wireless communication function via the third path. In this case, as shown in a graph <702*c*> of FIG. 7C, the frequency resonance is optimized at a frequency band of 850 MHz.

According to various embodiments of the present disclosure, when the electronic device is connected with an accessory, the antenna performance improving method selects at least one of a plurality of electrical paths between a radio frequency (RF) interface and a ground member, in response to the connection with the accessory, and minimizes the change in the resonant frequency caused by the connection of the accessory, thereby improving the antenna performance of the electronic device.

The term "module" as used in the present disclosure may mean a unit including one of hardware, software, and firmware or any combination of two or more of them. For example, the "module" may be interchangeable with the term "logic", "logical block", "component", or "circuit". The "module" may be the smallest unit of an integrated component or a part thereof. The "module" may be the smallest unit that performs one or more functions or a part thereof. The "module" may be mechanically or electronically implemented. For example, the "module" may include at least one of an application-specific integrated circuit (ASIC) chip, a field-programmable gate arrays (FPGA), and a programmable-logic device for performing certain operations, which are now known or will be developed in the future. Part of the method (e.g., operations) or system (e.g., modules or functions) according to various embodiments of the present disclosure can be implemented with instructions that can be conducted via various types of computers and stored in computer-readable storage media, as types of programming modules. The processor (e.g., processor 120) can execute instructions, thereby performing the functions. Examples of computer-readable media include: hard disks, floppy disks, magnetic tape, optical media (e.g., CD-ROM disks, DVDs, magneto-optical media, floptical disks, etc.), built-in memory, etc. Examples of the instructions include machine codes which are produced by compilers or can be executed by interpreters. Modules or programming modules according to various embodiments of the present disclosure may include at least one of modules, remove part of the modules described above, or include new modules. The operations performed by modules, programming modules, or the other modules, according to various embodiments of the present disclosure, may be executed in serial, parallel, repetitive or heuristic fashion. Part of the operations can be executed in any other order, skipped, or executed with additional operations.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. An electronic device comprising:

a housing;

an antenna located inside the housing;

a radio frequency (RF) interface configured to transmit and receive wireless signals via the antenna;

an electrical connector;

a ground member;

a processor electrically connected to the RF interface and the electrical connector; and a memory electrically connected to the processor, wherein the memory stores instructions enabling the processor to:

detect whether an external electrical connector is inserted into the electrical connector while the electronic device performs a communication function, determine whether to change an electrical path between the RF interface and the ground member based on a result of detecting whether the external electrical connector is inserted into the electrical connector, and in response to determining to change the electrical path, select at least one of a plurality of electrical paths between the RF interface and the ground member, based on a frequency band used to perform the communication function, wherein electrical length of each of the plurality of electrical paths is different.

2. The electronic device of claim 1, wherein the instructions enable the processor to select:

a first path of the plurality of electrical paths when the external electrical connector is not inserted to the electrical connector; and a second path of the plurality of electrical paths when the external electrical connector is inserted to the electrical connector.

3. The electronic device of claim 1, wherein:

the RF interface is configured to perform transmission and reception of signals less than or equal to a frequency of 1 gigahertz (GHz); and the instructions enable the processor to switch a first electrical path of the plurality of electrical paths to a second electrical path, when the signals of the frequency of 1 GHz are transmitted and received.

4. The electronic device of claim 1, wherein the memory stores:

a switching table containing information regarding a switch driving signal corresponding to at least one external electrical connector according to frequency bands.

5. The electronic device of claim 1, further comprising:

a switch, wherein the instructions enables the processor to:

create a switch driving signal corresponding to the detected external electrical connector based on a stored switching table; and select at least one of the plurality of electrical paths based on the switch driving signal transmitted to the switch via at least one general purpose input and output pin.

6. The electronic device of claim 2, wherein the first path includes an electrical length that differs from that of the second path.

7. The electronic device of claim 6, wherein the electrical length of the first path is greater than that of the second path.

8. The electronic device of claim 2, wherein:

the first path comprises a first magnitude of inductance; and the second path comprises a second magnitude of inductance.

9. The electronic device of claim 8, wherein the first magnitude of inductance is greater than the second magnitude of inductance.

10. The electronic device of claim 1, wherein the external electrical connector comprises at least one of an audio jack, an earphone jack, a universal serial bus (USB) connector, or a metallic accessory.

* * * * *